US005996211A

United States Patent [19]

Nathrath et al.

[11] Patent Number: 5,996,211

[45] Date of Patent: Dec. 7, 1999

[54] PROCESS FOR MANUFACTURING POLARIZATION-SELECTIVE REFLECTORS

[75] Inventors: Norbert Nathrath, Taufkirchen; Bernd Abt, Markdorf; Thomas Kutscheid, Meersburg, all of Germany

[73] Assignee: DaimlerChrysler AG, Germany

[21] Appl. No.: 09/054,527

[22] Filed: Apr. 3, 1998

[30] Foreign Application Priority Data

Apr. 3, 1997 [DE] Germany ..... 197 13 735

[51] Int. Cl.[6] ..... H01P 11/00

[52] U.S. Cl. ..... 29/600; 29/846

[58] Field of Search ..... 29/600, 846

[56] References Cited

U.S. PATENT DOCUMENTS

| | | | |
|---|---|---|---|
| 4,816,836 | 3/1989 | Lalezari | 29/846 |
| 4,937,425 | 6/1990 | Chang et al. | 29/600 X |
| 4,937,935 | 7/1990 | Clariou | 29/846 |
| 5,017,940 | 5/1991 | Rigollet | 29/600 X |
| 5,495,262 | 2/1996 | Klebe | 29/600 X |
| 5,771,027 | 6/1998 | Marks et al. | 29/600 X |

FOREIGN PATENT DOCUMENTS

| | | |
|---|---|---|
| 2 139 076 | 2/1972 | Germany . |
| 2 139 076 C2 | 8/1982 | Germany . |
| 634 691 A5 | 2/1983 | Switzerland . |

*Primary Examiner*—Carl J. Arbes
*Attorney, Agent, or Firm*—Evenson,McKeown, Edwards & Lenahan P.L.L.C.

[57] ABSTRACT

In a process for manufacturing gratings for polarization-selective reflectors a linear grating is constructed via a known depositing machine in the form of a wire which is continuously deposited side-by-side on a reflector shape. The shell is subsequently constructed such that the previously constructed grating is partially embedded in the shell. The grounding of the grating takes place outside the reflector by connecting (soldering/clamping) the projecting ends of the grating wire to a grounding wire or grounding band.

10 Claims, 2 Drawing Sheets

PROCESS FOR MANUFACTURING POLARIZATION-SELECTIVE REFLECTORS

BACKGROUND AND SUMMARY OF THE INVENTION

This application claims the priority of German patent document 197 13 735.0, filed Apr. 3, 1997, the disclosure of which is expressly incorporated by reference herein.

The present invention relates to a process for manufacturing gratings for polarization-selective reflectors (PSR) which can be used particularly as parabolic antennas suitable for space operations. As a rule, such a reflector consists of two reflecting shells which are arranged behind one another. The shell which is in front (viewed in the direction of the incidence of the electromagnetic waves) reflects only signals of one polarization and transmits signals of the opposite polarization. This is achieved by applying a linear grating to the front shell. In special cases, the reflector will consist only of a shell carrying a grating.

Optimal transmissions and reflections are achieved by a special construction. Here, a linear grating, which is applied to the surface of a high-frequency-transparent shell, permits an optimal reflection. The optimal transmission is achieved by a special design with respect to material and dimensioning for the dielectric shell. In the case of this construction, the structure function and the high-frequency function are largely coupled.

Swiss Patent Document CH 634 691 describes a radar reflector which consists of a plastic shaped body in a cell construction having electromagnetically reflecting grating webs mounted on an exterior side. An electromagnetically absorbing material is charged into the cells of the plastic shaped body. In this manner, the absorbing material (required for achieving polarizing properties) is protected at reasonable cost from harsh weather patterns. In this case, the linear grating is produced by mounted parallel grating bars.

From the Article by P. Edenhofer, M. Galka, J. Habersack, which appeared in *nzt-Archive,* 6th Edition, 1984, Volume 10, Page 249, and on, a polarization-separating dipole grating is known for offset reflector antennas used in communication and remote sensing satellites. With dipole gratings, a broad-band copolar reflection can be achieved while the cross-polarization distance is increased simultaneously. In this case, the grating is produced by the clamping-on of parallel wire gratings or by the vapor-depositing of parallel strip gratings.

The German Patent Document DE-OS 21 39 076 describes short-wave antennas which use linearly polarized short waves, in order to obtain a selective reflection and radiation on certain surfaces. For this purpose, a number of conductive gratings are provided in front of a reflector whose admittances and mutual distances and whose distances with respect to the reflector are dimensioned such that (at any of several operating frequencies), the concerned admittances for components of a linearly polarized wave, disposed perpendicularly on one another, have a relatively inverse size and an opposite preceding sign. The production of the grating takes place by gluing-on the parallel wires.

The previous techniques of producing gratings have the disadvantage of being highly priced. This is due to the high-expenditure manufacturing technique and a risk caused by passive intermodulation as a function of the manufacturing technique (for example, laser cutting technique or mechanical machining plus photo etching technique).

A polarization-selective antenna should be classified in a category of satellite payload antennas.

Rising efficiency requirements and high cost-related pressure, require the use of new technologies in communication satellites. The principle of asymmetrically fed parabolic antennas, also called offset reflector antennas, is particularly significant because of its favorable constructive properties (that is, a lack of shading caused by the supply system and its holding device). By means of this type of antenna, radiation diagrams with low minor lobes can be achieved in simply or complexly bordered areas. This is accomplished by using multiple supply systems in combination with parabolic reflectors or, by using individual supply systems in combination with reflectors which have an especially shaped surface deviating from the parabola.

In the case of a linear polarization, the principle of the initially described polarization-selective reflector (PSR) is used for achieving high cross-polarization purity. The (front) shell reflects signals of a linear polarization and transmits signals of the orthogonal polarization direction.

In this case, the reflector materials, which are used for polarization-selective parabolic antennas suitable for space operations, are becoming increasingly important because of constantly increasing frequency and precision requirements.

This is particularly true in the case of a joint transmitting and receiving operation using one antenna. Here, in addition to requiring a high reflectivity for the desired polarization and a low reflectivity for the orthogonal polarization, the polarization-selective reflector also requires a grating technology which is free of passive intermodulation (PIM). The two first requirements determine the material and the geometry of the grating and the dielectric carrier. The meeting of the third requirement is significantly connected to the manufacturing process of the grating.

It is an object of the present invention to provide a simple, low-cost and high-precision process for the manufacturing of the grating of the (front) shell of a polarization-selective reflector. The grating produced according to the new process is free of passive intermodulation (PIM).

Based on a known process of depositing fiber bundles, this object is achieved by constructing the grating via a depositing machine (known per se) in the form of wires/fibers. These wires/fibers are deposited side-by-side on a reflector shape and the shell is subsequently built up thereon such that the grating constructed beforehand is partially embedded in the shell. Silver wires of a diameter of, for example, 50 $\mu$m can be advantageously used as fibers for the grating.

The wires are therefore deposited in a numerically controlled manner on the reflector shape, which is provided with a special adhesive layer (removable afterwards). The reflector shape is subject to no special limitations; that is, it may be parabolic or have a special shape.

On the thus deposited wire grating, whose dimensions are selected to be adapted to the high frequencies (typical dimensions: wire diameter$\leqq$0.05 mm; d (distance from wire to wire)=0.5 to 1.5 mm), the reflector shell is constructed in a conventional manner. An example of this conventional construction is a multilayer kevlar prepreg layer system for the front covering (a honeycomb core), and a rear covering which is identical with the front covering. The whole sandwich, including the grating, is glued together on the shape at a predetermined temperature. In this case, the grating is partially embedded in the resin system of the front covering.

In the current process, the depositing geometry of the grating is not disturbed and it therefore has virtually the same precision which is achieved by means of a numerically controlled machine. This is true almost irrespective of the surface shape of the reflector. In addition, if the selection of the depositing parameters (prestress/depositing rate) is correct, the wires are deposited without any interruption. This results in freedom from passive intermodulation. The two additional, consequently affected parameters (current-carrying contacts between different metals and current-carrying contacts through semiconducting layers on metal surfaces) are basically avoided because of the type of grating. Here, only a silver wire material is used. Contacts between wires do not occur within the grating.

Another favorable aspect of this manufacturing technique of the grating is the design of the grounding. In order to avoid critical electrostatic charging, conductive structures must be grounded. In the case of the new manufacturing technique for gratings, several alternatives are available for this purpose.

First, the grating consists of a quasi endless wire which is deposited in a meandering manner and grounded at both ends.

Second, the grating consists of several partial wires whose ends are led out beyond the edge and are connected in low-field zones with a grounding wire by clamping or soldering. In both cases, the grounding connection is situated outside the active reflector zone.

As the result of the described manufacturing technique for the grating, (i.e., the use of a depositing machine known per se, in the case of which the individual wire strand of the grating is deposited in a numerically controlled manner), a very simple, precise construction of the grating of a polarization-selective reflector can be achieved at a reasonable cost. This is accomplished with a high degree of precision and freedom from PIM.

Other objects, advantages and novel features of the present invention will become apparent from the following detailed description of the invention when considered in conjunction with the accompanying drawings.

DETAILED DESCRIPTION OF THE DRAWINGS

Figure 2:
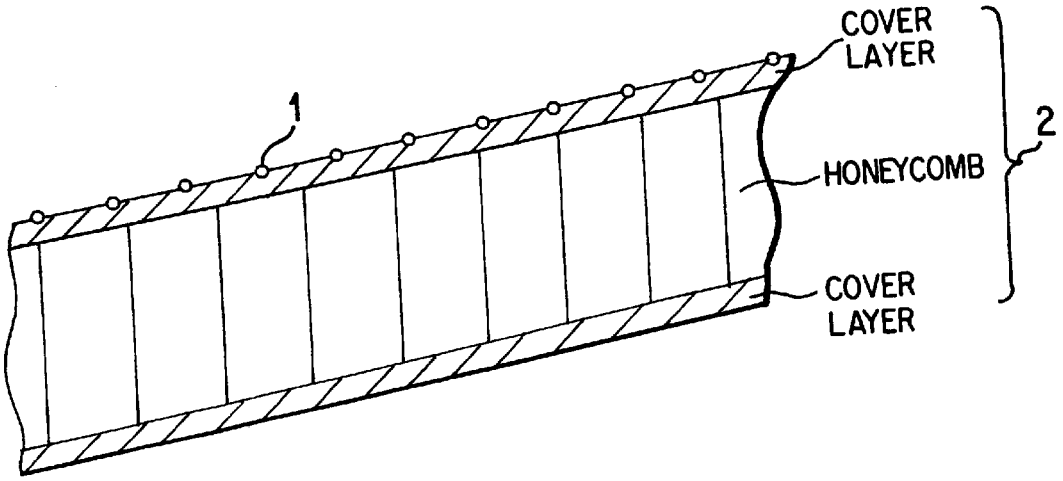
FIG. 2 is a sectional view of the reflector shell.

In the sectional view of FIG. 2, reference number 1 indicates the grating of the (front) shell produced according to the invention, and reference number 2 indicates the (front) shell of a polarization-selective reflector.

Figure 1:
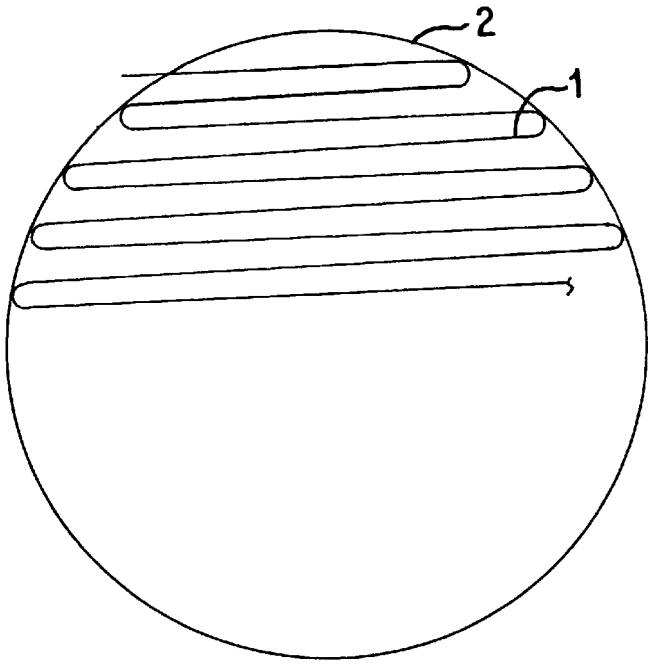
FIG. 1 is a top view of a grating according to the invention.

FIG. 1 is a top view of the (front) shell of the reflector, and FIG. 2 is a sectional view of the shell. Shown is a linear grating 1 consisting of electrically conductive fibers (preferably metallic wires, such as silver wires), having a diameter of, for example, 50 $\mu$m. The grating was deposited by a depositing machine (not shown) in a numerically controlled form, side-by-side on a reflector shape. After depositing the grating, a sandwich is constructed in a conventional manner from a resin-impregnated kevlar structure (prepreg) and honeycomb on the shape covered with the grating so that, subsequent to manufacturing the (front) shell, the grating is partially embedded in the resin layer of the front covering.

Figure 3:
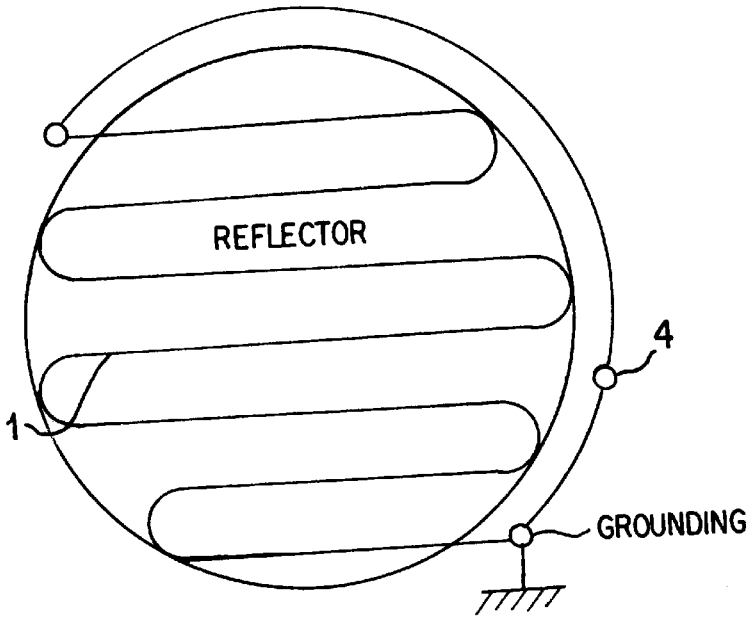
FIGS. 3 and 4 are views of grounding concepts of the grating.
Figure 4:
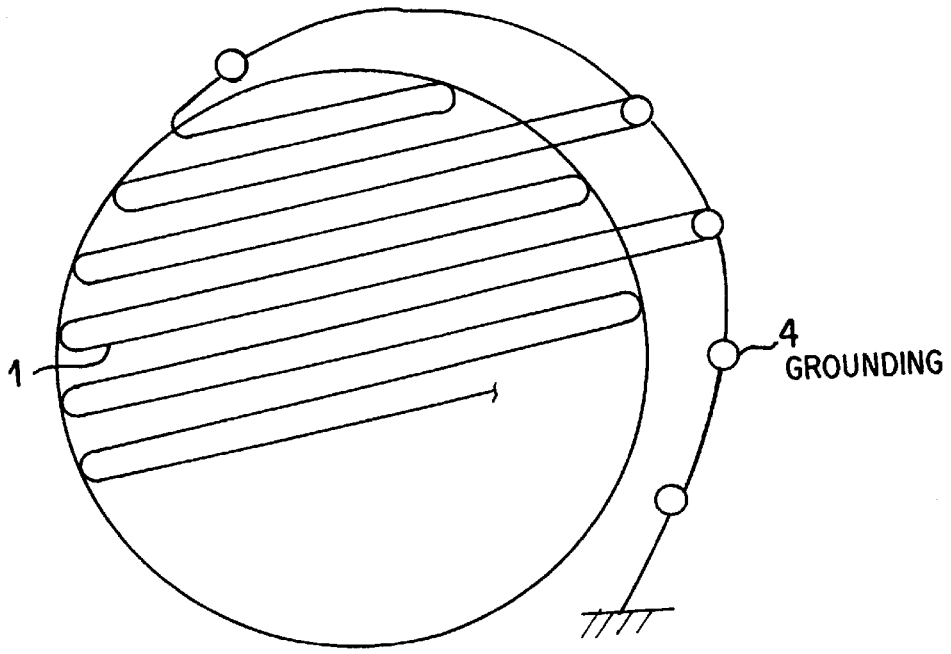

FIGS. 3 and 4 illustrate two possible grounding concepts for the wire grating. FIG. 3 illustrates the depositing of an endless wire 1 which is connected at both ends outside the reflector with a grounding wire 4. FIG. 4 shows the grounding of a construction of the grating of long partial wires 1 are connected with the grounding wire 4 at the ends led out beyond the reflector wall. The partial wires 1, which are deposited in a meandering manner.

By means of the process according to the invention, an advantage is achieved whereby, at reasonable costs, gratings of a particularly high quality can be produced on arbitrarily shaped reflector surfaces. Furthermore, the known depositing machine can be used via a targeted depositing and subsequent construction of a linear grating.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A process for manufacturing a polarization-selective reflector shell having a linear grating thereon, for reflecting signals of a first polarization and transmitting signals of a second polarization, the process comprising:

using a depositing machine to construct the grating in the form of a conductive fiber which is continuously deposited side-by-side on a reflector shape having a surface contour which is one of parabolic and specially shaped;

applying a resin layer to a front covering of the shell; and subsequently constructing the shell on said grating so that the grating is at least partially embedded in the resin layer applied to the front covering of the shell.

2. A process according to claim 1, wherein silver wire with a diameter of 50 $\mu$m is used as the fiber for the grating.

3. A process according to claim 1, wherein the ends of the grating wire are extended beyond an edge of the reflector and connected with a grounding wire or a grounding band outside the active grating region.

4. A process according to claim 2, wherein the ends of the grating wire are extended beyond an edge of the reflector and connected with a grounding wire or a grounding band outside the active grating region.

5. A process for manufacturing gratings for a reflector shell of polarization-selective reflectors, the process comprising the steps of:

continuously depositing a conductive fiber in a side-by-side manner on a reflector shape with said depositing machine with a depositing machine to produce a linear grating;

applying a resin layer to a front covering of the shell; and partially embedding the grating in the resin layer applied to said front covering of the shell.

6. A process according to claim 5, wherein silver wire with a diameter of 50 $\mu$m is used as the fiber for the grating.

7. A process according to claim 5, wherein the ends of the grating wire are extended beyond an edge of the reflector and connected with a grounding wire or a grounding band outside the active grating region.

8. A process according to claim 5, wherein the ends of the grating wire are extended beyond an edge of the reflector and connected with a grounding wire or a grounding band outside the active grating region.

9. A process according to claim 5, wherein the reflector shell only reflects signals of one polarization and transmits signals of an opposite polarization.

10. A process according to claim 5, wherein the reflector shape is a parabolic.

* * * * *